US006891096B2

(12) United States Patent
Guay

(10) Patent No.: US 6,891,096 B2
(45) Date of Patent: May 10, 2005

(54) CHROMATIC WIND INSTRUMENT

(76) Inventor: Germain Guay, 12435, 87th avenue, Rivière-des-Prairies, Quebec (CA), H1C 1J5

( * ) Notice: Subject to any disclaimer, the term of this patent is extended or adjusted under 35 U.S.C. 154(b) by 0 days.

(21) Appl. No.: 10/811,820

(22) Filed: Mar. 30, 2004

(65) Prior Publication Data

US 2005/0066793 A1 Mar. 31, 2005

Related U.S. Application Data

(60) Provisional application No. 60/505,437, filed on Sep. 25, 2003.

(51) Int. Cl.[7] ..... G10B 1/00
(52) U.S. Cl. ..... 84/331
(58) Field of Search ..... 84/330, 331, 349

(56) References Cited

U.S. PATENT DOCUMENTS

| | | | |
|---|---|---|---|
| 500,433 | A | 6/1893 | Shubert |
| 2,167,582 | A | 7/1939 | McCord |
| 4,770,080 | A | 9/1988 | Jivoin |
| 6,342,662 | B1 | 1/2002 | Chang |

FOREIGN PATENT DOCUMENTS

| | | | |
|---|---|---|---|
| CH | 693 250 | A5 | 4/2003 |
| CN | 2220671 | Y | 2/1996 |
| DE | 1574 35 | | 10/1982 |
| DE | 299 11 915 | U1 | 11/1999 |
| DE | 299 11 913 | U1 | 12/1999 |
| FR | 2 360 954 | | 3/1978 |
| FR | 2 523 752 | | 9/1983 |
| GB | 1 513 121 | | 6/1978 |
| KR | 1985-0002128 | | 9/1985 |
| KR | 0122960 | | 12/1998 |
| SU | 1348900 | A1 | 10/1987 |

*Primary Examiner*—Jeffrey W Donels

(57) ABSTRACT

A wind instrument comprising a plurality of pipes each having a respective open. The instrument also comprises a plurality of movable elements each configured to move in relation to a corresponding one of the plurality of pipes and defining a respective movable end of the corresponding one of the plurality of pipes. Each of the plurality of pipes has an effective length defined by its respective open end and its respective movable end. The wind instrument further comprises a mechanism coupled to the plurality of movable elements, the mechanism being operative for simultaneously reciprocating each of the movable elements between a respective first position and a respective second position. The reciprocation of each of the movable elements induces an absolute change in the effective length of each of the plurality of pipes, the absolute change in the effective length being different for each of the plurality of pipes.

31 Claims, 11 Drawing Sheets

CHROMATIC WIND INSTRUMENT

CROSS-REFERENCE TO RELATED APPLICATION

The present application claims the benefit under 35 U.S.C. 119(e) of U.S. provisional application No. 60/505,437 filed on Sep. 25, 2003.

FIELD OF THE INVENTION

The invention relates to wind instruments and, more particularly, to a wind instrument comprising a plurality of pipes.

BACKGROUND OF THE INVENTION

The pan flute is a musical instrument that has gained increased popularity over recent years, partly as a result of the mainstream appearance of recording artists such as Zamfir. A pan flute is typically composed of a series of parallel pipes of graduated lengths having open upper ends into which a player blows. Through proper selection of the lengths and diameters of the pipes, the pan flute is set up to play different notes of a musical scale.

Typically, the pipes of a pan flute have fixed lengths such that each pipe can produce only the note corresponding to its respective length and diameter. As a result, pan flutes are usually permanently tuned by design and manufacture considerations. This implies that the user of a pan flute designed to cover, say, a diatonic scale, will experience great difficulty in playing flats or sharps belonging to the corresponding chromatic scale. Consequently, this places a severe restriction on the songs that can be played on a conventional pan flute.

Moreover, although the above discussion referred specifically to pan flutes, other wind instruments having a plurality of pipes that are permanently tuned by design and manufacture considerations suffer from the same drawbacks.

While various solutions to the above problems have been proposed, none of these is satisfactory and thus there remains a need in the industry to provide a wind instrument that alleviates at least in part the problems associated with existing wind instruments having multiple pipes.

SUMMARY OF THE INVENTION

In accordance with a first broad aspect, the invention provides a wind instrument comprising a plurality of pipes each having a respective open end. The instrument also comprises a plurality of movable elements each configured to move in relation to a corresponding one of the plurality of pipes and defining a respective movable end of the corresponding one of the plurality of pipes. Each of the plurality of pipes has an effective length defined by its respective open end and its respective movable end. The wind instrument further comprises a mechanism coupled to the plurality of movable elements, the mechanism being operative for simultaneously reciprocating each of the movable elements between a respective first position and a respective second position. The reciprocation of each of the movable elements induces an absolute change in the effective length of each of the plurality of pipes, the absolute change in the effective length being different for each of the plurality of pipes.

The plurality of pipes may be parallel and the open ends of the plurality of pipes may be arranged in substantially linear alignment when viewed from a point in a common plane that is perpendicular to the pipes. Alternatively, the plurality of pipes may be parallel and the open ends of the plurality of pipes may be arranged in a curve when viewed from a point in a common plane that is perpendicular to the pipes. As well, the respective movable end defined by each one of the movable elements may be either a closed end or an open end for the corresponding one of the pipes.

In a specific embodiment, each of the movable elements comprises a protrusion and the mechanism comprises a member defining a plurality of apertures. Each one of the apertures is configured to receive the protrusion of a corresponding one of the movable elements such that actuation of the member causes each one of the movable elements to simultaneously move between its respective first position and its respective second position. Each one of the apertures may have a substantially oblong configuration or a curved configuration.

Alternatively, each one of the movable elements may define an aperture on a surface thereof and the mechanism may comprise a member having a plurality of protrusions. In this case, the aperture of each one of the movable elements is configured to receive a corresponding one of the plurality of protrusions such that actuation of the member causes each one of the movable elements to simultaneously move between its respective first position and its respective second position.

The member may be pivotally mounted to the instrument and the mechanism may further include an actuator configured to cause pivotal movement of the member. The actuator may be capable of acquiring a first position in which the member occupies a first angular position and in which each of the movable elements occupies its respective first position. The actuator may also be capable of acquiring a second position in which the member occupies a second angular position and in which each of the movable elements occupies its respective second position. Furthermore, the actuator may comprise a manual push button or a foot pedal. The actuator may also comprise a stop to inform a player that the actuator has acquired the second position. In addition, the mechanism may further comprise a coil spring for urging the member to pivot between the first and second angular positions.

In a particular example of implementation, each one of the movable elements comprises a hollow tube in slidable axial engagement with the corresponding one of the pipes. The hollow tube may have an open end and a closed end, the closed end of the hollow tube defining the movable end of the corresponding one of the pipes. Alternatively, the hollow tube may have a first open end and a second open end, the second open end of the hollow tube defining the movable end of the corresponding one of the pipes. Furthermore, each hollow tube may be adapted to slide axially within the corresponding one of the pipes or, alternatively, each hollow tube may be adapted to slide axially on an outer surface of the corresponding one of the pipes. In some cases, each one of the movable elements further comprises a threaded rod mounted to a complimentarily threaded base. Rotation of the rod with respect to the base causes axial displacement of the piston of the respective one of the movable elements in relation to the open end of the corresponding one of the pipes to allow fine-tuning of the effective length of the corresponding one of the pipes.

In a specific embodiment, each one of the movable elements is locked against rotational movement about the corresponding one of the pipes. To achieve this, each one of the apertures may be configured to interact with the received protrusion of the corresponding one of the movable elements such as to cause the corresponding one of the movable elements to reciprocate between its respective first position and its respective second position without rotating in relation to the corresponding one of the pipes.

In addition, the effective length of each of the plurality of pipes may be greater when the corresponding movable element occupies its respective first position than when the corresponding movable element occupies its respective second position. Alternatively, the effective length of each of the plurality of pipes may be greater when the corresponding movable element occupies its respective second position than when the corresponding movable element occupies its respective first position.

Furthermore, the absolute change in the effective length of each of the plurality of pipes may define a relative change in the effective length of that pipe, wherein the relative change in the effective length of each of the pipes is substantially identical. In one specific embodiment, the relative change is approximately equal to $$\sqrt[12]{2}$$

while in another specific embodiment, the relative change is approximately equal to $$\sqrt[12]{1/2}.$$

.

In accordance with a second broad aspect, the invention provides a method of playing a wind instrument having a plurality of pipes each with an open end and a movable end, the open end and the movable end of each pipe defining an effective length of that pipe. The method comprises blowing into the open end of a selected one of the pipes to produce a first musical note having a first fundamental frequency. Then, the method comprises actuating a mechanism to simultaneously vary the effective length of the selected one of the pipes and the effective length of at least one of the pipes other than the selected one of the pipes. The actuation of the mechanism is such that the variation of the effective length of the selected one of the pipes is different from the variation of the effective length of the at least one of the pipes other than the selected one of the pipes. Finally, the method comprises blowing into the open end of the selected one of the pipes to produce a second musical note having a second fundamental frequency.

In one specific embodiment, the second fundamental frequency is a half-tone above or below the first fundamental frequency. In another specific embodiment, the second fundamental frequency is a quarter-tone above or below the first fundamental frequency.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of the embodiments of the present invention is provided herein below, by way of example only, with reference to the accompanying drawings, in which.

Figure 1:
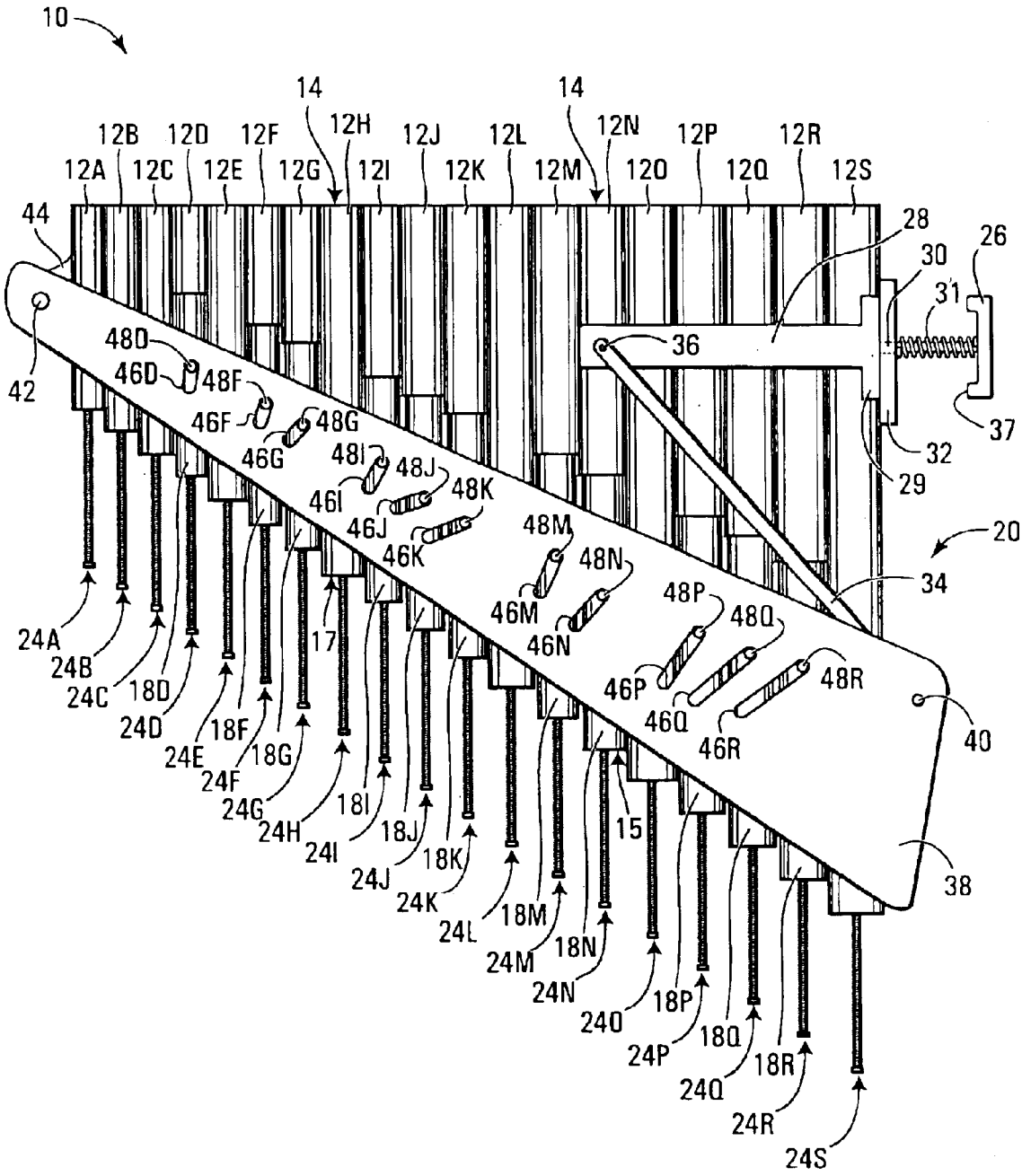
FIG. 1 is a front view of a wind instrument in accordance with a first specific embodiment of the invention.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

In FIG. 1, a wind instrument in accordance with an embodiment of the present invention is illustrated generally and identified by reference numeral 10. The wind instrument 10 comprises a plurality of pipes 12A–12S, collectively referred to as 12. Each one of the pipes 12 has an open end 14 into which a player of the instrument blows. As well, the instrument 10 comprises a plurality of movable elements 18D, . . . , 18R, collectively referred to as 18. Each one of the movable elements 18 is adapted to move in relation to a respective one of the pipes 12 and defines a movable end 15 of that pipe. The axial distance between the open end 14 and the movable end 15 of each one of the pipes. 12 associated with one of the movable elements 18 defines an effective length of that pipe. Other ones of the pipes 12 are not associated with one of the movable elements 18 and have a respective non-movable end 17. The axial distance between the open end 14 and the non-movable end 17 of each one of these other pipes 12 not associated with one of the movable elements 18 defines an effective length of that pipe.

In the specific embodiment shown, pipes 12D, 12F, 12G, 12I, 12J, 12K, 12M, 12N, 12P, 12Q and 12R are each associated with a respective one of the movable elements 18 (i.e., pipe 12D is associated with movable element 18D, pipe 12F is associated with movable element 18F, and so on). In general, each one of the pipes 12 or only selected ones of the pipes 12 may be associated with a respective one of the movable elements 18. In addition, as further described below, the movable end 15 or the non-movable end 17 of each one of the pipes 12 can be either a closed end or an open end.

The wind instrument 10 further comprises a mechanism 20 coupled to the movable elements 18. The mechanism 20, when actuated by a player via actuator 28, simultaneously moves each one of the movable elements 18 from a respective first position to a respective second position along the longitudinal axis of the respective one of the pipes 12 with which the movable element is associated. This induces an absolute change in the effective length of each one of the pipes 12 associated with a respective one of the movable elements 18. In addition, the actuator 28 allows the player to controllably reciprocate the mechanism 20 allowing each one of the movable elements 18 to be controllably reciprocated between its respective first position and its respective second position during playing of the instrument 10. In turn, this enables the player to produce two sets of musical notes while playing the instrument 10, the first set of notes being produced when each one of the movable elements 18 occupies its respective first position and the second set of notes being produced when each one of the movable elements 18 occupies its respective second position.

In one embodiment, each one of the pipes 12 associated with a respective one of the movable elements 18 produces a respective natural note of the diatonic scale in the absence of actuation of the mechanism 20, and produces a respective corresponding sharp note when the mechanism 20 is actuated. In other embodiments, each one of the pipes 12 associated with a respective one of the movable elements 18 produces a respective natural note in the absence of actuation of the mechanism 20, and produces a respective corresponding flat note when the mechanism 20 is actuated. In still other embodiments, each one of the pipes 12 associated with a respective one of the movable elements 18 produces a respective natural note of the chromatic scale in the absence of actuation of the mechanism 20 and, upon actuation of the mechanism 20, produces a respective note that is a quarter-tone above or below the respective note that it produces in the absence of actuation of the mechanism 20. It is noted that in order to achieve the effect of a sharpened (or flattened) note for each one of the pipes 12 associated with a respective one of the movable elements 18, different variations in effective length are required for each one of those pipes. In turn, this implies that the absolute displacement of each one of the movable elements 18 between its respective first position and its respective second position is different from one of the movable elements 18 to the other.

Figure 2:
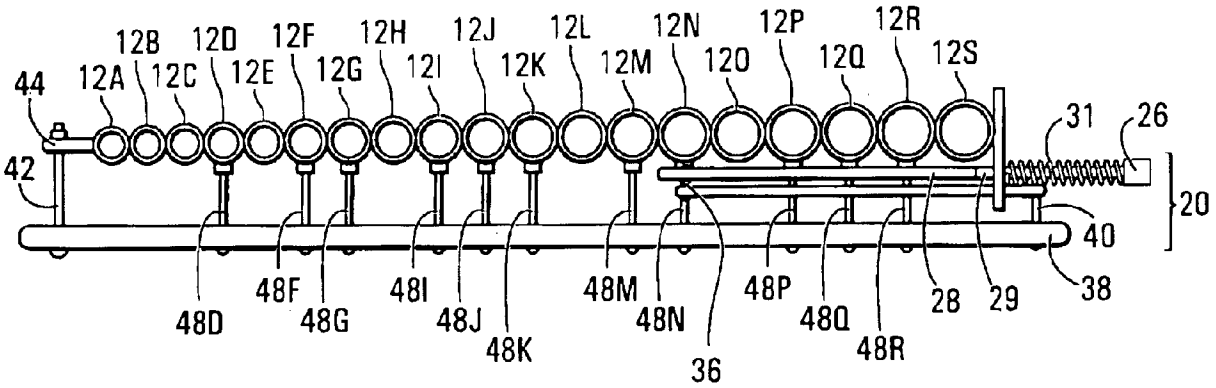
FIG. 2 is a top view of the wind instrument shown in FIG. 1.
Figure 3:
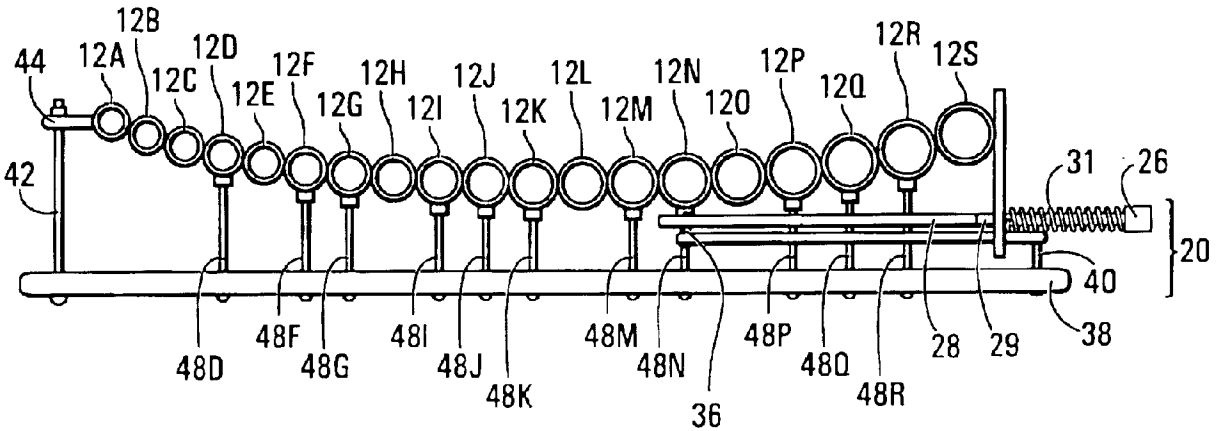
FIG. 3 is a top view of an alternate embodiment of the instrument shown in FIG. 1.

In the embodiment shown in FIGS. 1 and 2, the plurality of pipes 12 is a series of parallel and adjacent metal pipes of graduated lengths and arranged in substantially linear alignment. Adjacent ones of the pipes 12 are secured to one another using a welded joint. Alternatively, the pipes 12 of the instrument 10 may be secured together using connecting brackets and fasteners or they may all be connected to a lateral support structure. In any case, it is to be understood that various other means can be employed to secure the pipes 12 in the wind instrument 10 and that various other materials such as plastics, ceramics and composites may be used in making the pipes 12 without departing from the spirit and scope of the invention. Moreover, it is also to be understood that, although the embodiment presented shows pipes having graduated lengths, various other patterns of pipe length may be used, including pipes having substantially identical lengths, without detracting from the scope of the present invention. As well, as shown in FIG. 3, the plurality of pipes 12 may be a series of parallel and adjacent pipes arranged in a curve rather than in substantially linear alignment.

Figure 4:
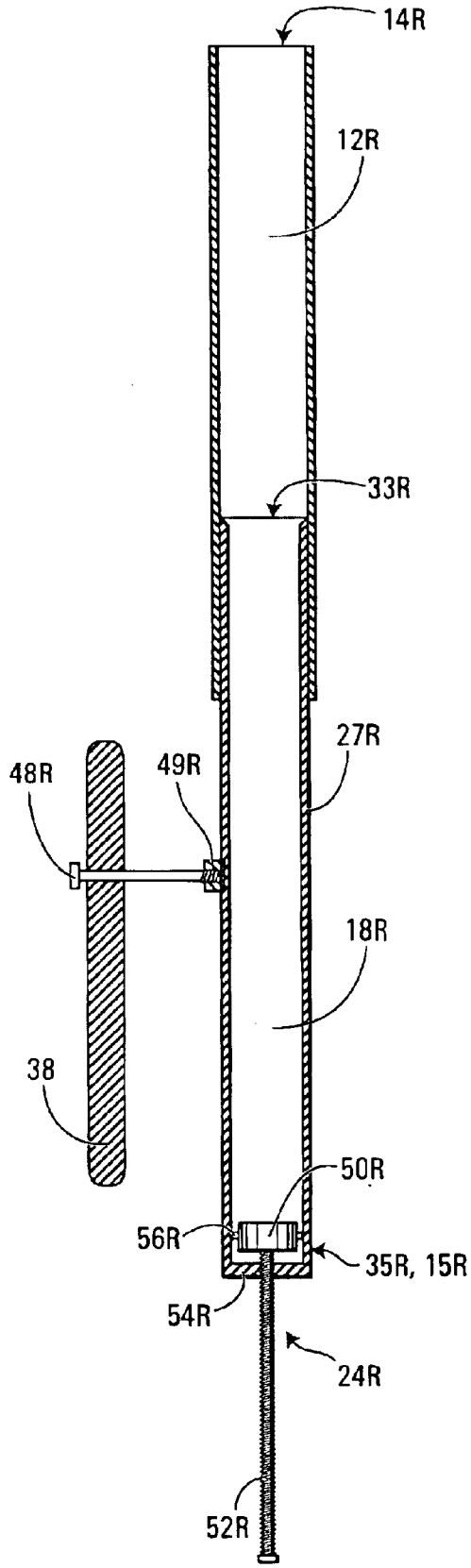
FIG. 4 is a section side view of pipe 12R shown in FIG. 1.

FIG. 4 shows a section side view of pipe 12R, although it will be appreciated that the following description also applies to the other pipes 12 associated with one of the movable elements 18 (i.e. pipes 12D, 12F, 12G, 12I, 12J, 12K, 12M, 12N, 12P and 12Q). In this non-limiting example of implementation, the movable element 18R is a hollow tube 27R having a first end 33R that is open and a second end 35R that is closed, the closed end 35R of the hollow tube 27R defining the movable end 15R of the pipe 12R. However, it is to be understood that, in other embodiments, the second end 35R of the hollow tube 27R may be left open. In the specific embodiment shown, the hollow tube 27R has a piston assembly 24R disposed at its second end 35R, the piston assembly 24R defining the closed end 35R of the hollow tube 27R.

The hollow tube 27R has an outer diameter that is sufficiently smaller than the inner diameter of the pipe 12R such as to allow the hollow tube 27R to slide axially within the pipe 12R. It is to be noted that in an embodiment in which adjacent ones of the pipes 12 are separated from each other, the hollow tube 27R may have an inner diameter that is sufficiently larger than the outer diameter of the pipe 12R such as to allow the hollow tube 27R to slide axially on the outer surface of the pipe 12R.

The piston assembly 24R includes a piston 50R mounted to a threaded rod 52R that is screwed into a complementarily threaded base 54R, the base 54R essentially functioning as a fixed nut. Optionally, the piston 50R may be equipped with a gasket 56R, such as an O-ring. Thus, in addition to the variation of the effective length of the pipe 12R associated with the operation of the mechanism 20, the player may fine-tune the effective length of the pipe 12R by adjusting the position of the piston 50R within the pipe 12R through a rotation of the threaded rod 52R. Nonetheless, it is to be noted that the piston assembly 24R may be omitted from the hollow tube 27R, in which case the second end 35R of the hollow tube 27R may be closed by having an integrally formed closed end or any other plugged element that would prevent air blown in the pipe 12R from passing straight through and leaving the pipe 12R.

As well, and as can be seen in FIG. 1, each one of the pipes 12 that is not associated with one of the movable elements 18 may also be equipped with a respective one of a plurality of piston assemblies 24A, . . . , 24S to close its respective non-movable end 15. However, as mentioned above, each one of the piston assemblies 24A, . . . , 24S is optional and may be omitted from any one of those pipes, in which case the non-movable end 15 of any one of those pipes may be closed by having an integrally formed closed end or any other plugged element that would prevent air blown in the pipe from passing straight through and leaving the pipe. Alternatively, the non-movable end 15 of each one of those pipes may also be left open.

With reference to FIGS. 1, 2 and 4, the mechanism 20 operative for simultaneously moving each one of the movable elements 18 from its respective first position to its respective second position will now be described. In the non-limiting example of implementation shown, the mechanism 20 includes an actuator link 28 having a push button 26 mounted at one of its ends. The actuator link 28 is adapted to slide in a bore 30 of a first bracket 32 when a player applies a pushing force on the push button 26. The first bracket 32 is secured to one of the pipes 12 of the instrument 10 by a welded joint. Alternatively, the first bracket 32 may be formed integrally with one of the pipes 12 or may be secured to the lateral support structure of the instrument 10 if such a lateral support structure is present.

Optionally, the actuator link 28 has a polygonal cross-section (such as a rectangular cross-section) and the bore 30 has a matching polygonal configuration in order to prevent the actuator link 28 from turning in the bore 30 when the push button 26 is pushed by the player. Furthermore, the actuator link 28 may have a protrusion 29 that can abut against the first bracket 32 to define a first position of the actuator link 28 in relation to the bracket 32. Also, the actuator link 28 may have a stop 37 to inform the player that the actuator link 28 has been pushed into a second position in which the mechanism 20 has moved each of the movable elements 18 to its respective second position. Additionally, a coil spring 31 may be mounted between the push button 26 and the first bracket 32 such as to urge the actuator link 28 back to the first position when the pushing force on the push button 26 ceases to be applied.

The mechanism 20 further includes a member 38 connected to the actuator link 28 by a linkage that may comprise a coupler link 34 pivotally connected to the actuator link 28 through a first pin 36 and pivotally connected to the member 38 through a second pin 40. The member 38 is pivotally mounted to the instrument 10 by a third pin 42 secured in a second bracket 44. In a specific example of implementation, the second bracket 44 is secured by a welded joint to one of the pipes 12 of the instrument 10. Here again, the second bracket 44 may be formed integrally with one of the pipes 12 or may be secured to the lateral support structure of the instrument 10 if such a lateral support structure is present.

The member 38 defines a plurality of apertures 46D, . . . , 46R, collectively referred to as 46, the configuration and distribution of which will be described in further detail below. Each one of the apertures 46 receives a respective one of a plurality of protrusions 48D, . . . , 48R, collectively referred to as 48, that is connected to a respective one of the movable elements 18. In the specific embodiment shown, and as best seen in FIG. 4, the protrusion 48R is in the form of a rod having a threaded section allowing for the rod to be screwed in a complementarily tapped protuberance 49R of the movable element 18R. Alternatively, the protrusion 48R may be formed integrally with and as a projection of the movable element 18R, or it may be formed separately and welded to the movable element 18R. Other embodiments of the protrusions 48 will be apparent to those skilled in the art and are within the scope of the invention.

In this specific embodiment, the actuator link 28, the coupler link 34, the member 38, and the protrusions 48 are made of aluminum, although other metals, such as brass and steel, and plastic, ceramic and composite materials may be used without detracting from the spirit and scope of the invention.

Figure 5:
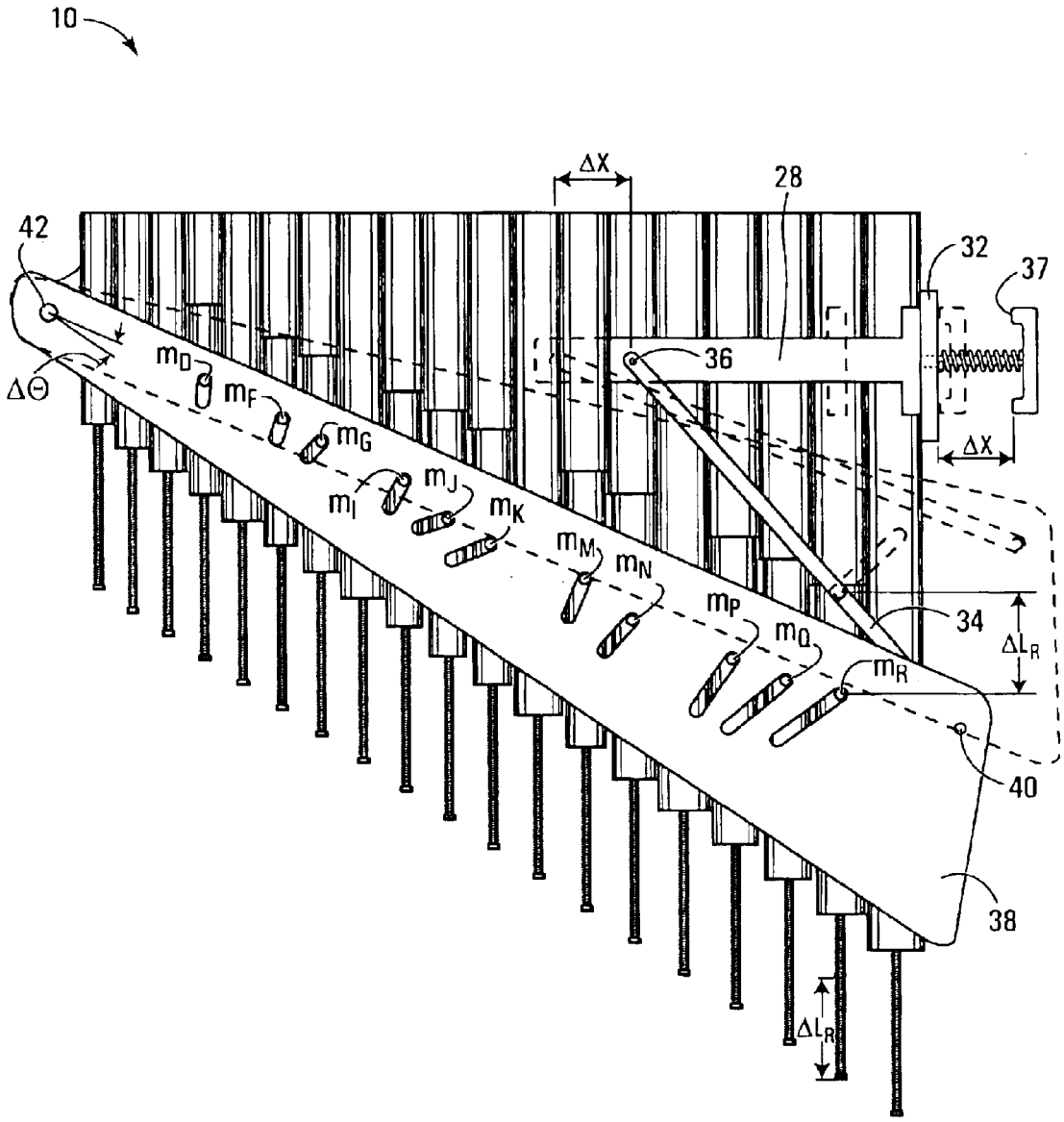
FIG. 5 shows the motion of a mechanism of the wind instrument shown in FIG. 1.

It will thus be appreciated that the actuator link 28, the coupler link 34, the member 38, and the brackets 32 and 44 cooperate to move as a four-bar linkage, with the brackets 32 and 44 representing the fixed frame. As can be seen in FIG. 5, when the player pushes on the push button 26 until the stop 37 abuts against the bracket 32, the actuator link 28 is translated to the left by a distance denoted by $\Delta x$. As a result of the constraints imposed by the pin connections 36, 40 and 42 and of its length, the coupler link 34 experiences a general planar motion by virtue of which it is translated to the left and rotated counterclockwise. By way of the pin connection 40, the member 38 originally occupying a first angular position pivots about the fixed pin 42 through a specific rotation angle denoted by $\Delta\theta$, resulting in the member 38 occupying a second angular position. Through the interplay between the protrusions 48 and the apertures 46, each one of the movable elements 18 is simultaneously translated axially by a respective displacement $\Delta L_D, \ldots, \Delta L_R$ with respect to the respective one of the pipes 12 with which it is associated (in the interest of clarity, only the displacement $\Delta L_R$ of movable element 18R is shown in FIG. 5). In addition, the configurations of the apertures 46 of the member 38 are such as to cause a respective displacement $\Delta L_D, \ldots, \Delta L_R$ of each one of the movable elements 18 that may be different from one movable element to the other, as will now be described.

To begin with, it is noted that when air is blown into a pipe, such as one of the pipes 12, a standing sound wave having a fundamental frequency f is produced. Different fundamental frequencies give the appearance of different notes of a musical scale. Thus to play different notes of the musical scale, the fundamental frequency f must be changed.

Now, it can be shown that the fundamental frequency f is related to the length L between an open end and a closed end of a pipe and to the diameter D of the pipe according to the following relationship $$f = \frac{v}{4(L + 0.4D)} \tag{1}$$

where v is the speed of sound in air (which is approximately equal to 340 m/s under standard conditions). Thus, a specific musical note corresponding to a given fundamental frequency $f_1$ can be produced using, for example, the pipe 12R which has a specified diameter $D_R$ by establishing the effective length of the pipe $L_{R1}$ (defined as the distance between the open end 14 and the closed end 15 of the pipe 12R) using the above relationship.

To obtain a different note corresponding to a different frequency $f_2$ using the same pipe 12R of fixed diameter $D_R$, the effective length of the pipe 12R has to be changed from the length $L_{R1}$ to a length $L_{R2}$, which can also be established using the above relationship. Therefore, to obtain from the same pipe 12R the notes corresponding respectively to the frequencies $f_1$ and $f_2$, the effective length of the pipe 12R must be varied by an amount $\Delta L_R = |L_{R2} - L_{R1}|$. Accordingly, the configuration of the aperture 46R receiving the protrusion 48R associated with the pipe 12R must be such as to allow the movable element 18R to move axially by a distance $\Delta L_R$ in relation to the pipe 12R when the mechanism 20 is actuated by the player.

Generally, specific notes each corresponding to a respective given frequency $f_1$ can be produced using respective ones of the pipes 12 by specifying for each one of these pipes a diameter $D_D, \ldots, D_R$ and by establishing the effective length $L_{D1}, \ldots, L_{R1}$ of the pipe using equation (1) above. Likewise, to obtain a different note corresponding to a different frequency $f_2$ using each one of these pipes 12 of fixed diameter $D_D, \ldots, D_R$, the respective effective length of each pipe has to be changed from the length $L_{D1}, \ldots, L_{R1}$ to a length $L_{D2}, \ldots, L_{R2}$, which can also be established using equation (1) above. As a result, each one of the apertures 46 will have a respective configuration such as to allow for the respective one of the movable elements 18 with which it is associated to move simultaneously by a respective distance $\Delta L_i$ when the mechanism 20 is actuated by the player (where $\Delta L_i = |L_{i2} - L_{i1}|$, for i=D, F, G, I, J, K, M, N, P, Q and R). In other words, the configuration of each one of the apertures 46 will be such that the respective one of the protrusions 48 that it receives and, consequently, the respective one of the movable elements 18 with which it is associated are caused to move axially by the respective distance $\Delta L_i$ when the mechanism 20 is actuated, causing the member 38 to pivot from its first angular position by the angle $\Delta\theta$ to its second angular position.

The configurations of the apertures 46 of the member 3B are established as follows. Firstly, the diameters $D_A$–$D_S$ of the pipes 12 and the respective dimensions of the actuator link 28, the coupler link 34, and the member 38 are known (or may be selected as they represent free design parameters). Additionally, as described previously in connection with FIG. 5, the mechanism 20 essentially moves as a four-bar linkage such that, when the player pushes on the push button 26 until the stop 37 abuts against the bracket 32, the member 38 pivots about the fixed pin 42 by the angle $\Delta\theta$. Elementary kinematics relate the displacement $\Delta x$ by which the push button 26 is moved to the pivot angle $\Delta\theta$ and will not be described here. As such, the pivot angle $\Delta\theta$ can be assumed to be a known value.

Figure 6:
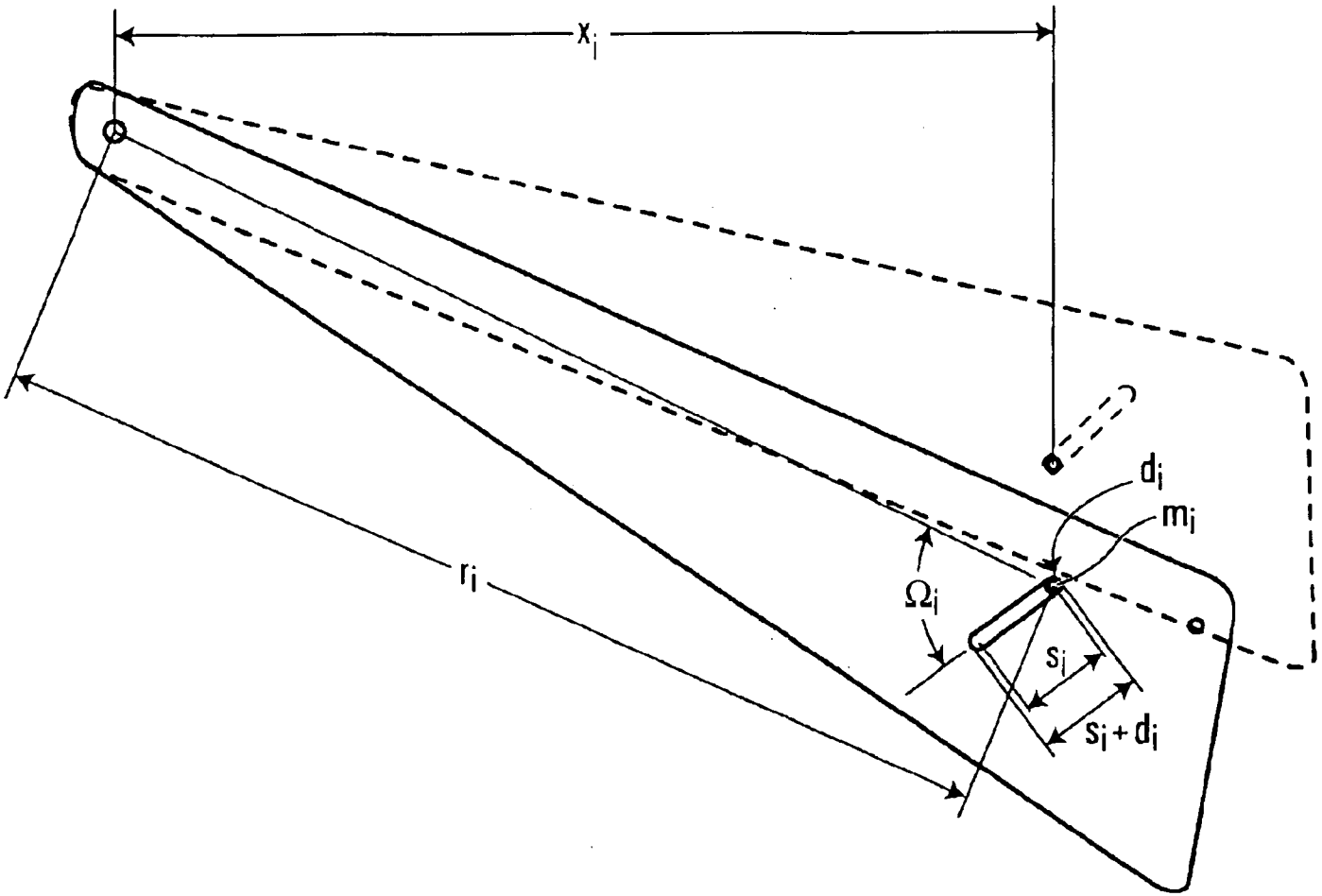
FIG. 6 presents the geometry of an aperture defined by a member of the mechanism of the wind instrument shown in FIG. 1.

In addition, as can be seen in FIGS. 5 and 6, with the actuator link 28 in its first position, the member 38 occupies its first angular position wherein a respective point $m_i$, for i=D, F, G, I, J, K, M, N, P, Q and R, is defined on the member 38 for each one of the pipes 12 associated with one of the movable elements 18. Each point $m_i$ corresponds to the position of one of the protrusions 48 connected to one of the movable elements 18 when the member 38 occupies its first angular position and the movable element occupies its respective first position. As such, each point $m_i$ is located at a respective distance $r_i$ from the pin 42. In order for each one of the protrusions 48 and associated one of the movable elements 18 to move by the respective distance $\Delta L_i$ when the member 38 pivots by the angle $\Delta\theta$, it can be shown using basic trigonometry that each one of the apertures 46 may be configured as a slot of a respective length $S_i$ extending from the respective point mA at a respective angle $\Omega_i$, with respect to a line connecting the respective point $m_i$ and the pin 42, where $$S_i = \sqrt{\left(\Delta L_i - \sqrt{r_i^2 - x_i^2} + r_i \sin(\cos^{-1}(x_i/r_i) - \Delta\theta)\right)^2 + (r_i \cos(\cos^{-1}(x_i/r_i) - \Delta\theta) - x_i)^2} \quad (2)$$

$$\Omega_i = \tan^{-1}\left(\frac{\Delta L_i - \sqrt{r_i^2 - x_i^2} + r_i \sin(\cos^{-1}(x_i/r_i) - \Delta\theta)}{r_i \cos(\cos^{-1}(x_i/r_i) - \Delta\theta) - x_i}\right) + \cos^{-1}(x_i/r_i) - \Delta\theta \quad (3)$$

and $x_i$ corresponds to the horizontal distance between the pin 42 and the respective point $m_i$.

The following non-limiting example illustrates a possible configuration of the aperture 46R in order for the pipe 12R to have the capability to produce both an "F natural" (F) note corresponding to a frequency $f_1$ of 174.6 Hz and an "F sharp" (F#) note corresponding to a frequency $f_2$ of 184.98 Hz. The pipes 12 of the instrument 10 have their diameters $D_A$–$D_S$ fixed such that in the case of pipe 12R, the diameter $D_R$ is set to be 1.5 cm. Using equation (1) above, the effective lengths $L_{R1}$ and $L_{R2}$ of the pipe 12R corresponding to the production of the F and F# notes are found to be 48.09 cm and 45.35 cm, respectively, resulting in a required variation in effective length $\Delta L_R$ of the pipe 12R of 2.74 cm.

Now, as mentioned previously, elementary kinematics allows the respective dimensions of the actuator link 28, the coupler link 34, and the member 38 to be selected such as to cause, for example, a pivot angle $\Delta\theta$ of 8° when the push button 26 is displaced by a displacement $\Delta x$ of 3 cm. With the above dimensions known, the point $m_R$ is established and its distance $r_R$ from the pin 42 is known to be 38 cm and the horizontal distance $x_R$ from the pin 42 to the point $m_R$ is known to be 25.4 cm. The above values are inserted in equations (2) and (3) above and the length $S_R$ and orientation angle $\Omega_R$ of the aperture 46R are determined to be 3.83 cm and 56.26°, respectively. In addition, as shown in FIG. 6, the actual length of the aperture 46R may be adjusted by a distance of 0.5 $d_R$ at each of its ends in order to take into account the diameter $d_R$ of the protrusion 48R connected to the movable element 18R. Accordingly, by being configured as an oblong slot having a length ($S_R$+$d_R$) of 4.13 cm (for a protrusion with a diameter $d_R$ of 0.3 cm) and oriented at an angle $\Omega_R$ of 56.26°, the aperture 46R causes for the movable element 18R to move by a distance $\Delta L_R$ of 2.74 cm when the mechanism 20 is actuated by the player of the instrument 10. As such, when blowing into the pipe 12R, the player can produce an F note corresponding to a frequency of 174.6 Hz by not pushing on the push button 26 and an F# note corresponding to a frequency of 184.98 Hz by pushing the push button 26.

The respective configuration of each of the other apertures 46 may be established using a method substantially identical to the one described above in respect of the aperture 46R. Moreover, the apertures 46 may be respectively configured such as to interact with the protrusions 48 in order to cause simultaneous displacements of each one of the movable elements 18 between its respective first position and its respective second position upon actuation of the mechanism 20. As a result, each one of the pipes 12 associated with a respective one of the movable elements 18 has the capability to produce at least two different notes when air is blown into it: the first note corresponds to the position of the respective movable element when the push button 26 is not pushed in (i.e., the actuator link 28 is in its first position) and the second note corresponds to the position of the respective movable element when the push button 26 has been pushed by the player (i.e., the actuator link 28 is in its second position).

In a specific example of implementation, each one of the pipes 18 associated with one of the movable elements 18 has the capability to produce both a respective natural note and a corresponding sharp note of the chromatic scale. As such, each one of the pipes 12 associated with one of the movable elements 18 produces a respective natural note of the chromatic scale such as F, C or G when the mechanism 20 is not actuated by the player. When the mechanism 20 is actuated, each one of the pipes 12 associated with one of the movable elements 18 produces the respective sharp note of the scale, such as F#, C# or G#, corresponding to the respective natural note that it produces when the mechanism 20 is not actuated. It is noted that, in such an embodiment, the absolute change in the effective length ($\Delta L_i$) of each one of the pipes 12 associated with one of the movable elements 18 defines a relative change of the effective length of each pipe as the effective length $L_{i2}$ is related to the effective length $L_{i1}$ according to $$L_{i1} = \sqrt[12]{2}\, L_{i2}.$$

In other words, the absolute change in the effective length ($\Delta L_i$) defines a relative change $$\Delta L_i = \left|\sqrt[12]{1/2} - 1\right| L_{i1}$$

that is substantially identical for all of the pipes (i.e., $$\Delta L_D = \left|\sqrt[12]{1/2} - 1\right| L_{D1},$$

$$\Delta L_F = \left|\sqrt[12]{1/2} - 1\right| L_{F1},$$

and so on). It is also noted that some sharp notes of the scale are equal to some natural notes of the scale, such as E#

(which has the same fundamental frequency as F) and B# (which has the same fundamental frequency as C), and can be achieved using the respective ones of the pipes 12 that produce the natural notes (i.e., F and C) without actuating the mechanism 20. Thus, it will be appreciated that not all of the pipes 12 need to be associated with a respective one of the movable elements 18. However, it is to be understood that the scope of the present invention is also intended to cover a situation wherein each one of the pipes 12 of the instrument 10 is associated with a respective one of the movable elements 18. In addition, it is also to be understood that the apertures 46 could be configured such that each one of the pipes 12 associated with one of the movable elements 18 has the capability to produce any desired pair of distinct notes (i.e., a first note corresponding to an arbitrarily selected first fundamental frequency $f_1$ and a second note corresponding to an arbitrarily selected second fundamental frequency $f_2$) without departing from the spirit and scope of the invention.

The above-described method for establishing the configuration of the apertures 46 was presented only for purposes of example. As such, it is to be understood that various other methods, even a trial and error procedure, could be employed to establish the respective configuration of each one of the apertures 46 without departing from the spirit and scope of the invention. As well, although the above example of implementation presented apertures 46 of substantially oblong configuration, it will be appreciated that apertures of any configuration, including curved configurations, could be designed to achieve the same end result, i.e. induce an absolute change in the effective length of each one of the pipes 12 associated with a respective one of the movable elements 18.

Furthermore, the configurations of the apertures 46 in the specific embodiment described above result in substantially pure translation of each one of the movable elements 18 in relation to the corresponding one of the pipes 12 to which it is associated, without any rotation of the movable element with respect to the pipe. However, it is to be understood that the apertures 46 could be configured to interact with the protrusions 48 such as to cause each one of the movable elements 18 to be axially displaced through a combination of an axial translation along, and a rotation about, the axis of the corresponding one of the pipes 12 with which it is associated and still achieve the desired variation in effective length.

Moreover, it will be appreciated that the linkage described above in connection with the mechanism 20 was for illustrative purposes only. Accordingly, the motion of the member 38 defining the apertures 46 may be generated using various other linkages and may even be controlled using electrical components (e.g. step motors) without detracting from the spirit and scope of the present invention. Additionally, although in the embodiment presented above the actuator link 28 with the push button 26 represented a manual form of actuation of the mechanism 20, it is to be understood that various other actuating means could be employed to allow the player to actuate the mechanism 20 without departing from the spirit and scope of the invention. For example, the mechanism 20 could include a foot pedal to enable the player to actuate the mechanism 20 by pressing down on the pedal with one of his or her feet.

Those skilled in the art will appreciate that various other modifications and refinements can be made to the embodiments presented above without detracting from the scope of the present invention.

Figure 7:
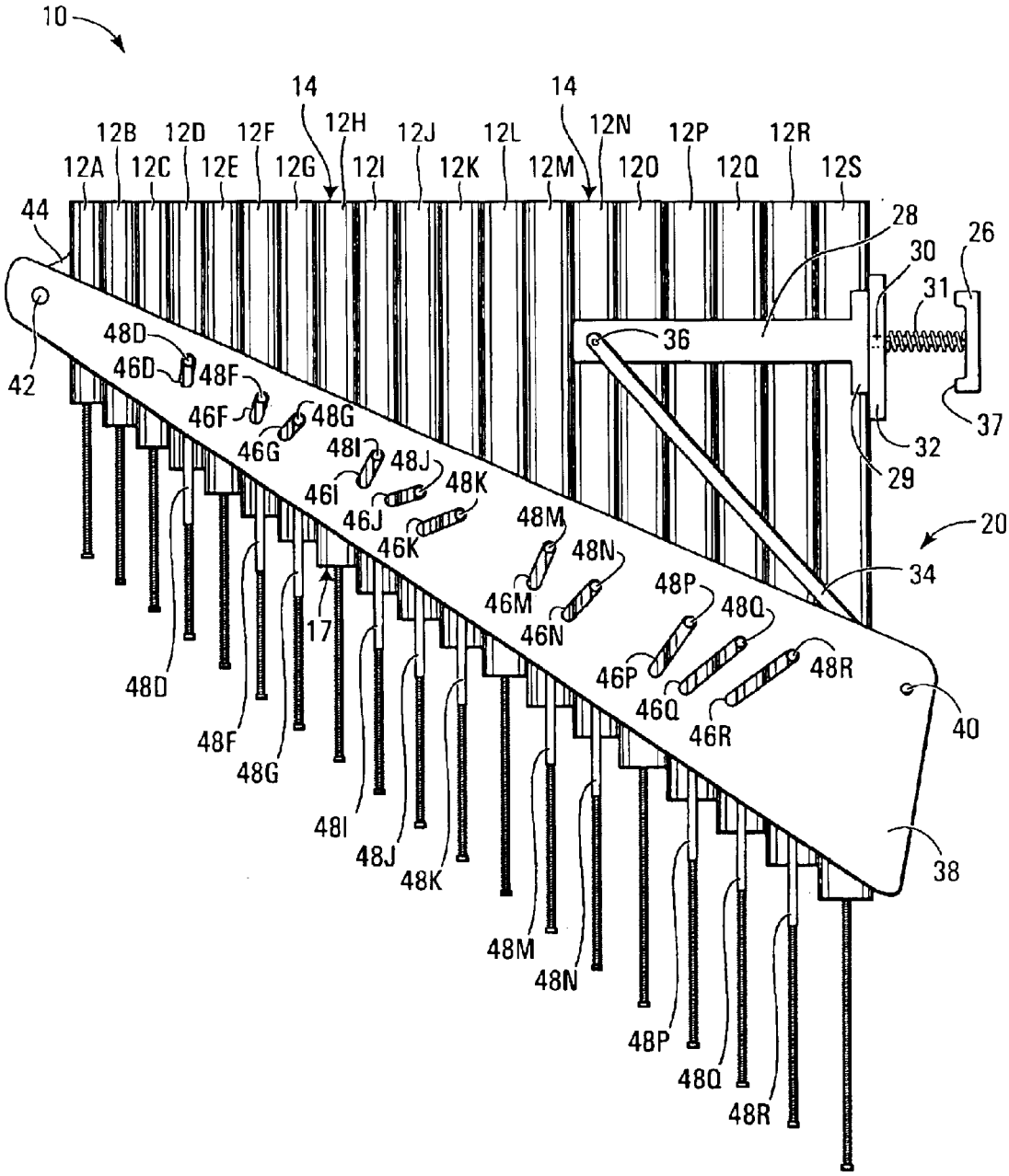
FIG. 7 is a front view of a wind instrument in accordance with a second specific embodiment of the invention.
Figure 8:
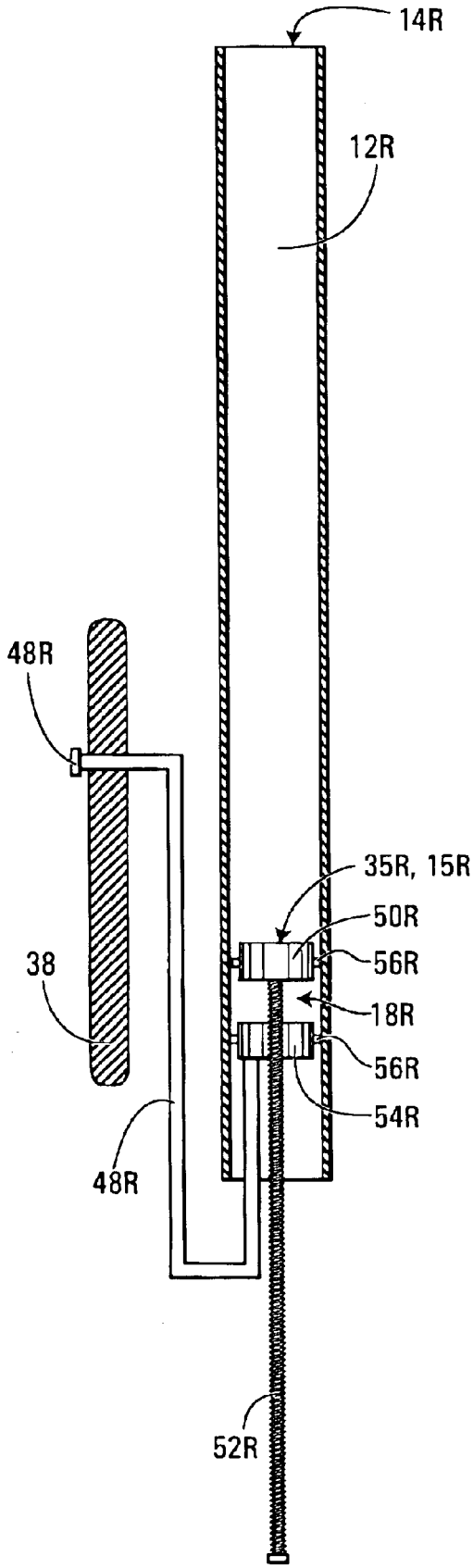
FIG. 8 is a section side view of pipe 12R shown in FIG. 7.
Figure 9:
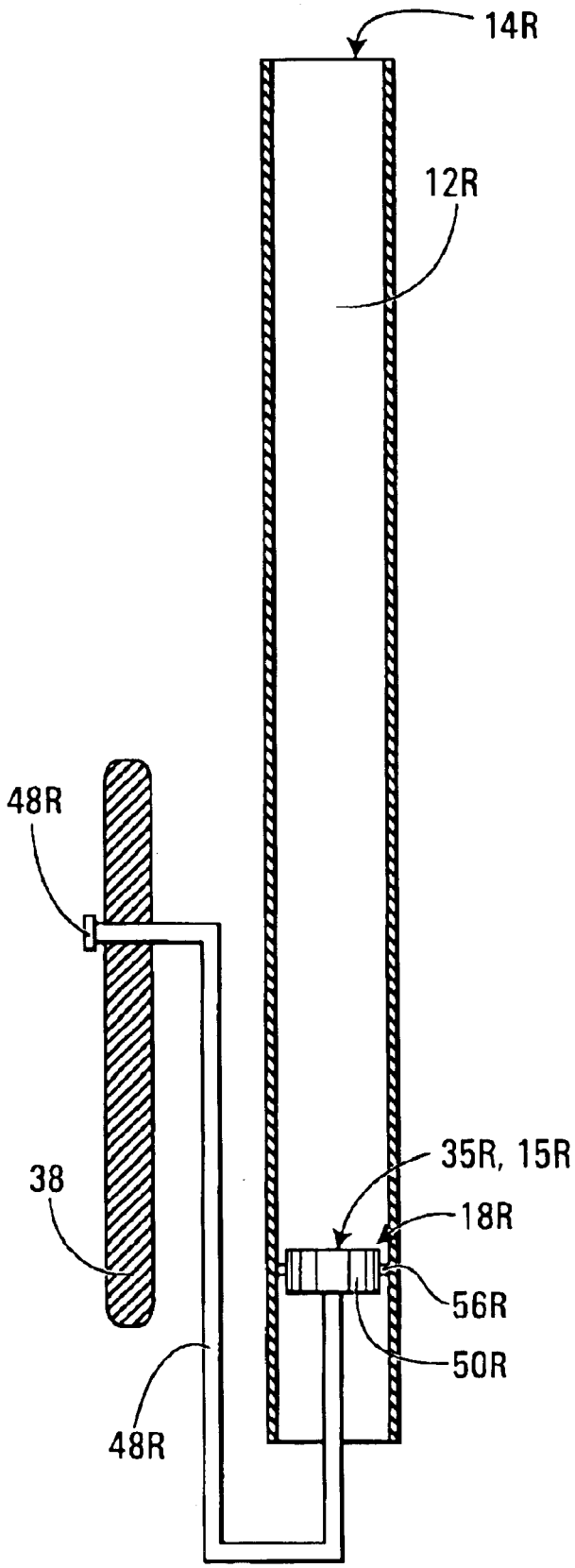
FIG. 9 is a section side view of a pipe 12R in accordance with a third specific embodiment of the invention.

For example, FIGS. 7 to 9 show alternate embodiments of the movable element 18R associated with the pipe 12R, although it is to be understood that the following description also applies to the other pipes 12 associated with a respective one of the movable elements 18 (i.e. pipes 12D, 12F, 12G, 12I, 12J, 12K, 12M, 12N, 12P and 12Q). In FIGS. 7 and 8, the movable element 18R is similar to the piston assembly 24R described previously in connection with FIG. 4, except that the threaded base 54R is linked to the member 38 via a bent protrusion 48R and is free to move within the pipe 12R. Here again, in addition to the variation of the effective length of the pipe 12R associated with the operation of the mechanism 20, the threaded rod 52R enables an individual adjustment of the effective length of the pipe 12R by adjusting the position of the piston 50R within the pipe 12R. In FIG. 9, the movable element 18R is essentially a piston 50R that is linked to the member 38 via a bent protrusion 48R and can move axially within the pipe 12R. In both of these embodiments, the movable element 18R can move inside the pipe 12R through its interaction with the member 38 of the mechanism 20, as previously described in connection with FIGS. 5 and 6.

In addition, although the previously-presented embodiments showed a reduction of the effective length of each one of the pipes 12 associated with one of the movable elements 18 upon actuation of the mechanism 20, it will appreciated that the mechanism 20 could be configured to cause an increase of the effective length of each one of those pipes upon actuation. In one specific embodiment in which the effective lengths of the pipes are increased by actuation of the mechanism 20, each one of the pipes 12 associated with one of the movable elements 18 produces a respective natural note of the chromatic scale such as B, D or G when the mechanism 20 is not actuated by the player and produces the corresponding flat note of the scale, such as Bb, Db or Gb when the mechanism 20 is actuated.

Also, although some of the specific embodiments presented above demonstrated a variation of the effective length of each one of the pipes 12 associated with one of the movable elements 18 in order to obtain from each pipe two notes separated by a half-tone, it is to be understood that the mechanism 20 could be configured to allow a variation of the effective length of each pipe such as to produce two notes separated by a quarter-tone. In fact, and as mentioned previously, the mechanism 20 can be configured such that each respective one of the pipes 12 associated with a respective one of the movable elements 18 has the capability to produce any desired pair of distinct notes.

Figure 10:
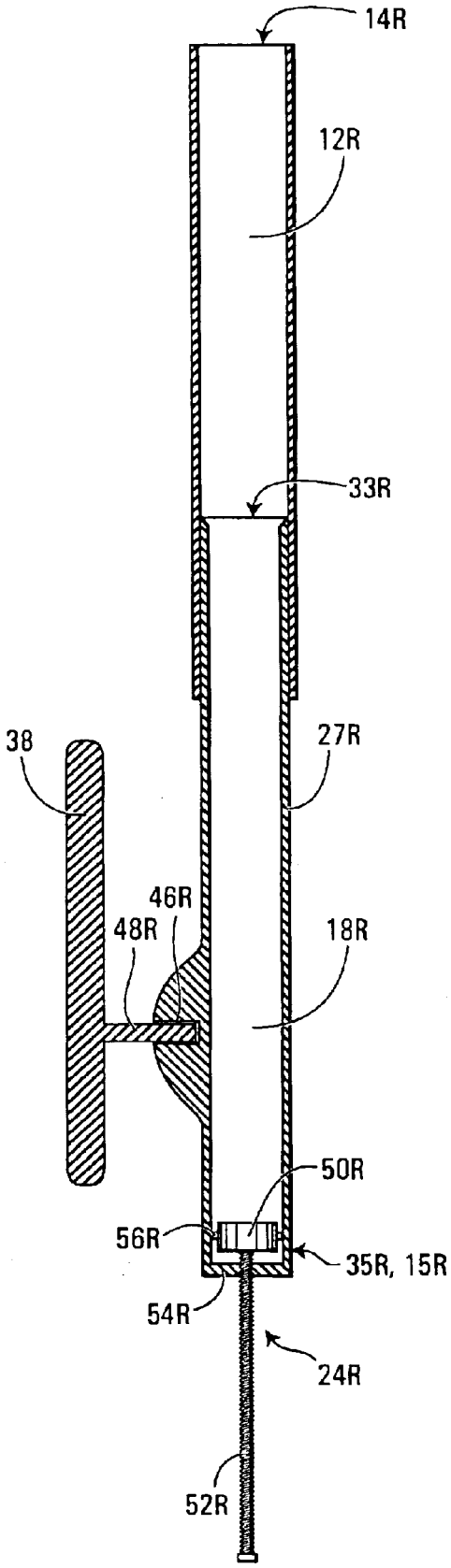
FIG. 10 is a section side view of a pipe 12R in accordance with a fourth specific embodiment of the invention.
Figure 11:
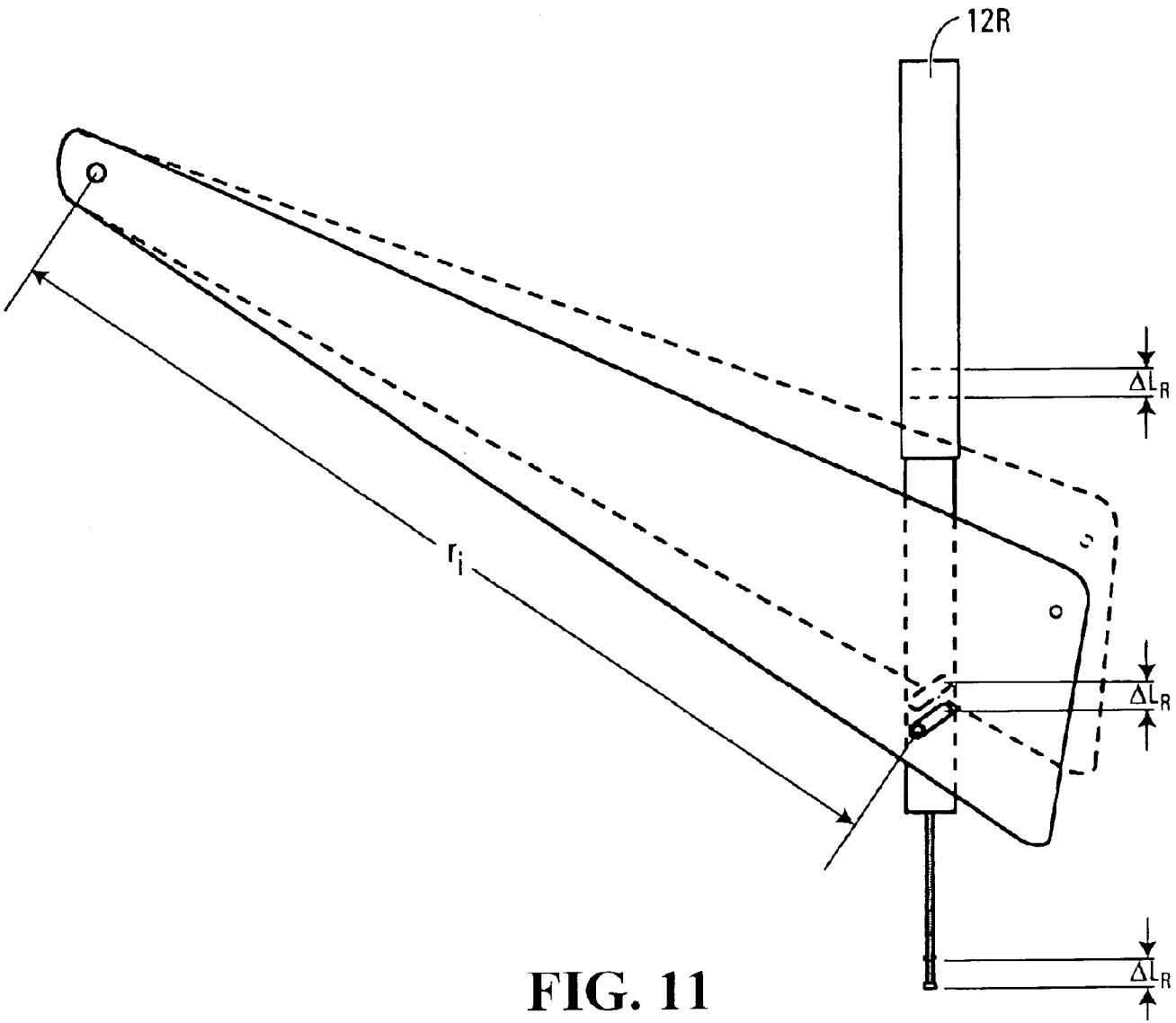
FIG. 11 shows the motion of the pipe 12R shown in FIG. 10.

Furthermore, it is to be understood that the components respectively defining each one of the protrusions 48 and each one of the apertures 46 may be interchanged. As such, FIGS. 10 and 11 show an embodiment in which the movable element 18R associated with the pipe 12R defines an aperture 46R receiving a protrusion 48R defined by the member 38 of the mechanism 20. The aperture 46R may be configured using any of the previously-mentioned techniques such that, upon actuation of the mechanism 20, the protrusion 48R defined by the member 38 interacts with the aperture 46R in order to cause the movable element 18R to move axially in relation to the pipe 12R, thereby varying the effective length of the pipe 12R by an amount $\Delta L_R$.

Figure 12:
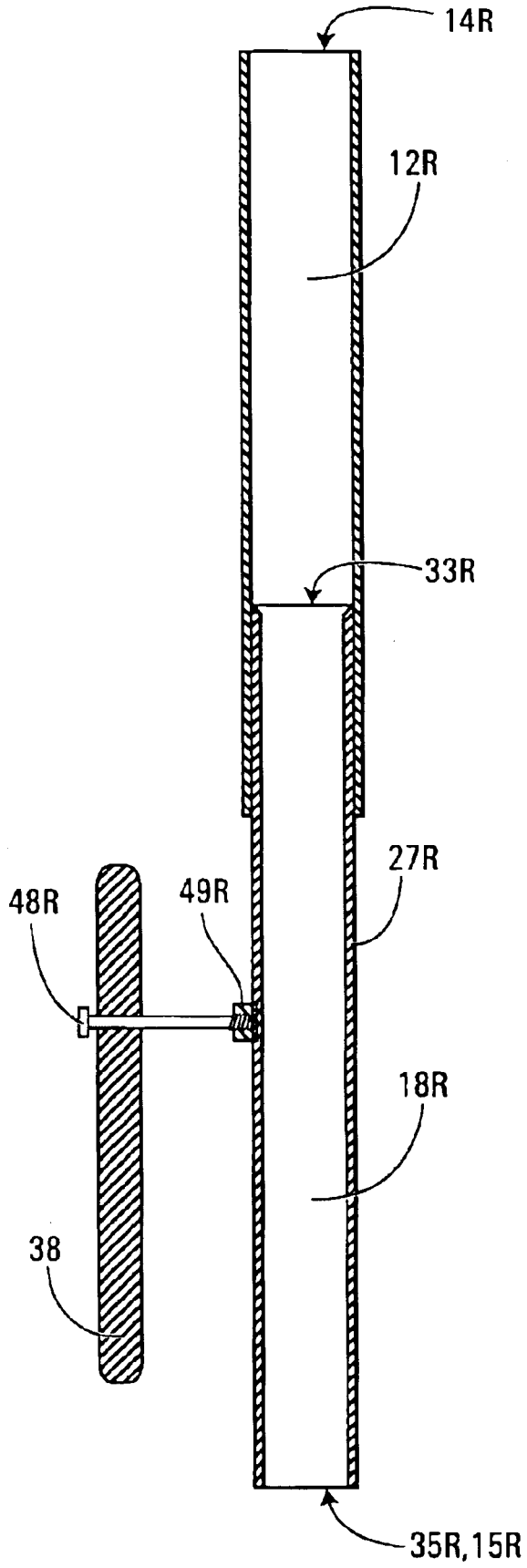
FIG. 12 is a section side view of a pipe 12R in accordance with a fifth specific embodiment of the invention.

Moreover, in other embodiments, the movable end 1S defined by any one of the movable elements 18 could be left open. For example, FIG. 12 shows a section side view of pipe 12R, although it is to be understood that the following description also applies to the other pipes 12 associated with one of the movable elements 18 (i.e. pipes 12D, 12F, 12G, 12I, 12J, 12K, 12M, 12N, 12P and 12Q). In this non-limiting example of implementation, the movable element 18R is a hollow tube 27R having a first end 33R that is open and a second end 35R that is also open, the open end 35R of the hollow tube 27R defining the movable end 15R of the pipe 12R.

In contrast to a pipe having a closed end, it can be shown that the standing sound wave produced when air is blown into a pipe having both ends open has a fundamental frequency f given by $$f = \frac{v}{2(L+0.8D)} \tag{4}$$

where L is the axial distance between the open ends of the pipe, D is the diameter of the pipe, and v is the speed of sound in air (which is approximately equal to 340 m/s under standard conditions). Accordingly, a first specific note corresponding to a given fundamental frequency $f_1$ and a second specific note corresponding to a given fundamental frequency $f_2$ can be produced using the pipe 12R in FIG. 12 which has a specified diameter $D_R$ by establishing the effective lengths of the pipe $L_{R1}$ and $L_{R2}$, respectively, using equation (4) abovec. With the effective lengths $L_{R1}$ and $L_{R2}$ known, the variation in effective length $\Delta L_R=|L_{R2}-L_{R1}|$ of the pipe 12R can be computed. A procedure substantially identical to that described above in connection with a pipe having a closed end may then be followed in order to configure the aperture 46R of the member 38 in order for the mechanism 20 to cause an axial displacement $\Delta L_R$ of the movable element 18R upon actuation.

The above description of the embodiments should not be interpreted in a limiting manner since other variations, modifications and refinements are possible within the spirit and scope of the present invention. The scope of the invention is defined in the appended claims and their equivalents.

What is claimed is:

1. A wind instrument comprising:

a plurality of pipes each having a respective open end;

a plurality of movable elements each configured to move in relation to a corresponding one of the plurality of pipes and defining a respective movable end thereof, wherein each of the plurality of pipes has an effective length defined by its respective open end and its respective movable end;

a mechanism coupled to the plurality of movable elements, the mechanism being operative for simultaneously reciprocating each of the movable elements between a respective first position and a respective second position thereby inducing an absolute change in the effective length of each of the plurality of pipes;

wherein the absolute change in the effective length is different for each of the plurality of pipes.

2. A wind instrument as defined in claim 1, the mechanism comprising a member mounted to the instrument, wherein actuation of the member causes each of the movable elements to simultaneously move between its respective first position and its respective second position.

3. A wind instrument as defined in claim 1, each of the movable elements comprising a protrusion, the mechanism comprising a member defining a plurality of apertures, wherein each of the apertures is configured to receive the protrusion of a corresponding one of the movable elements, wherein actuation of the member causes each of the movable elements to simultaneously move between its respective first position and its respective second position.

4. A wind instrument as defined in claim 1, each of the movable elements defining an aperture on a surface thereof, the mechanism comprising a member having a plurality of protrusions, wherein the aperture of each of the movable elements is configured to receive a corresponding one of the plurality of protrusions, wherein actuation of the member causes each of the movable elements to simultaneously move between its respective first position and its respective second position.

5. A wind instrument as defined in claim 2, wherein the member is pivotally mounted to the instrument, the mechanism further including an actuator configured to cause pivotal movement of the member, the actuator capable of acquiring:

a first position in which the member occupies a first angular position and in which each of the movable elements occupies its respective first position; and a second position in which the member occupies a second angular position and in which each of the movable elements occupies its respective second position.

6. A wind instrument as defined in claim 5, wherein the effective length of each of the plurality of pipes is greater when the corresponding movable element occupies its respective first position than when the corresponding movable element occupies its respective second position.

7. A wind instrument as defined in claim 5, wherein the effective length of each of the plurality of pipes is greater when the corresponding movable element occupies its respective second position than when the corresponding movable element occupies its respective first position.

8. A wind instrument as defined in claim 5, wherein the actuator comprises a manual push button.

9. A wind instrument as defined in claim 8, the actuator further comprising a stop to inform a player that the actuator has acquired the second position.

10. A wind instrument as defined in claim 5, wherein the actuator comprises a foot pedal.

11. A wind instrument as defined in claim 5, wherein the mechanism further comprises a coil spring for urging the member to pivot between the first and second angular positions.

12. A wind instrument as defined in claim 2, wherein the absolute change in the effective length of each of the plurality of pipes defines a relative change in the effective length of said pipe, wherein the relative change in the effective length of each of the pipes is substantially identical.

13. A wind instrument as defined in claim 12, wherein said relative change is approximately equal to $$\sqrt[12]{2}.$$

14. A wind instrument as defined in claim 12, wherein said relative change is approximately equal to $$\sqrt[12]{2}.$$

15. A wind instrument as defined in claim 1, wherein for each of the movable elements, the respective movable end defined by said movable element is a closed end for the corresponding one of the pipes.

16. A wind instrument as defined in claim 1, wherein for each of the movable elements, the respective movable end defined by said movable element is open.

17. A wind instrument as defined in claim 1, wherein each of the movable elements comprises a hollow tube in slidable axial engagement with the corresponding one of the pipes, the hollow tube having an open end and a closed end, the closed end of said hollow tube defining the movable end of the corresponding one of the pipes.

18. A wind instrument as defined in claim 1, wherein each of the movable elements comprises a hollow tube in slidable axial engagement with the corresponding one of the pipes, the hollow tube having a first open end and a second open end, the second open end of said hollow tube defining the movable end of the corresponding one of the pipes.

19. A wind instrument as defined in claim 17, wherein each hollow tube is adapted to slide axially within the corresponding one of the pipes.

20. A wind instrument as defined in claim 17, wherein each of the pipes has an outer surface, each hollow tube being adapted to slide axially on the outer surface of the corresponding one of the pipes.

21. A wind instrument as defined in claim 1, wherein each of the movable elements comprises a respective piston in slidable axial engagement within the corresponding one of the pipes, wherein the piston defines the movable end of the corresponding one of the pipes.

22. A wind instrument as defined in claim 21, each of the movable elements further comprising a threaded rod mounted to a complimentarily threaded base, wherein rotation of the rod with respect to the base causes axial displacement of the piston of the respective one of the movable elements in relation to the open end of the corresponding one of the pipes to allow fine-tuning of the effective length of the corresponding one of the pipes.

23. A wind instrument as defined in claim 3, wherein each of the apertures has a substantially oblong configuration.

24. A wind instrument as defined in claim 3, wherein each of the apertures has a curved configuration.

25. A wind instrument as defined in claim 1, wherein each of the movable elements is locked against rotational movement about the corresponding one of the pipes.

26. A wind instrument as defined in claim 3, wherein each of the apertures is configured to interact with the received protrusion of the corresponding one of the movable elements such as to cause the corresponding one of the movable elements to reciprocate between its respective first position and its respective second position without rotating in relation to the corresponding one of the pipes.

27. A wind instrument as defined in claim 1, wherein the plurality of pipes are parallel and wherein the open ends of the plurality of pipes are arranged in substantially linear alignment when viewed from a point in a common plane that is perpendicular to the pipes.

28. A wind instrument as defined in claim 1, wherein the plurality of pipes are parallel and wherein the open ends of the plurality of pipes are arranged along a curve when viewed from a point in a common plane that is perpendicular to the pipes.

29. A method of playing a wind instrument having a plurality of pipes each with an open end and a movable end, the open end and the movable end of each pipe defining an effective length of that pipe, the method comprising:

blowing into the open end of a selected one of the pipes to produce a first musical note having a first fundamental frequency;

actuating a mechanism to simultaneously vary the effective length of the selected one of the pipes and the effective length of at least one of the pipes other than the selected one of the pipes, wherein the absolute variation of the effective length of the selected one of the pipes is different from the absolute variation of the effective length of the at least one of the pipes other than the selected one of the pipes; and blowing into the open end of the selected one of the pipes to produce a second musical note having a second fundamental frequency.

30. A method as defined in claim 29, wherein the second fundamental frequency is a half-tone above or below the first fundamental frequency.

31. A method as defined in claim 29, wherein the second fundamental frequency is a quarter-tone above or below the first fundamental frequency.

* * * * *